US007485102B2

(12) United States Patent
Zake

(10) Patent No.: US 7,485,102 B2
(45) Date of Patent: Feb. 3, 2009

(54) METHOD AND DEVICE FOR FOOT THERAPY

(76) Inventor: Yamuna Zake, 295 W. 11th St., 1st Floor, New York, NY (US) 10014

( * ) Notice: Subject to any disclaimer, the term of this patent is extended or adjusted under 35 U.S.C. 154(b) by 814 days.

(21) Appl. No.: 10/412,058

(22) Filed: Apr. 11, 2003

(65) Prior Publication Data

US 2003/0195440 A1 Oct. 16, 2003

Related U.S. Application Data

(60) Provisional application No. 60/372,015, filed on Apr. 12, 2002.

(51) Int. Cl.
*A61H 7/00* (2006.01)

(52) U.S. Cl. ..... 601/134; 601/27; 601/136

(58) Field of Classification Search ..... 601/22, 601/27, 28, 118, 134, 135, 136, 137, 138; 606/204; 36/43, 44, 141; D24/211
See application file for complete search history.

(56) References Cited

U.S. PATENT DOCUMENTS 1,981,379 A * 11/1934 Thomson et al. ..... 601/28
4,126,129 A * 11/1978 Rainbow ..... 601/134
4,196,722 A * 4/1980 Vanderwoude ..... 601/41
4,421,110 A * 12/1983 DeLisle et al. ..... 601/134
4,589,880 A * 5/1986 Dunn et al. ..... 128/832
D285,116 S * 8/1986 Hoff ..... D24/214
4,852,553 A * 8/1989 Voykin ..... 601/28
5,096,188 A * 3/1992 Shen ..... 601/28
6,165,145 A * 12/2000 Noble ..... 601/111
6,228,001 B1 * 5/2001 Johnson et al. ..... 482/48
6,405,400 B1 * 6/2002 McClain ..... 601/136

* cited by examiner

*Primary Examiner*—Justine R Yu
(74) *Attorney, Agent, or Firm*—Ladas and Parry LLP

(57) ABSTRACT

A device for foot therapy has a central, generally spherical dome with a rim about a generally circular, generally planar base of the dome. Preferably, the dome is resilient to foot pressure. A system of foot therapy including the device supports the device on its base and presses a selected portion of the bottom of a foot against the dome. Preferably, the base of the dome is supported on a floor and the selected portion of the foot is pressed against the dome from a standing or chair-sitting position.

2 Claims, 5 Drawing Sheets

FIG. 5
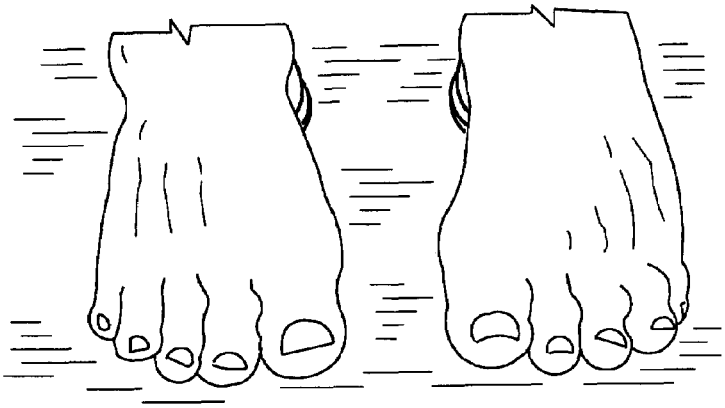
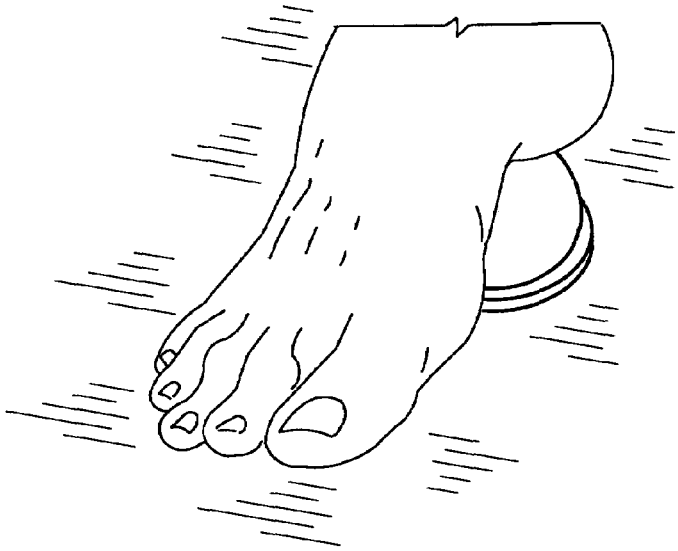
FIG. 6
FIG. 7
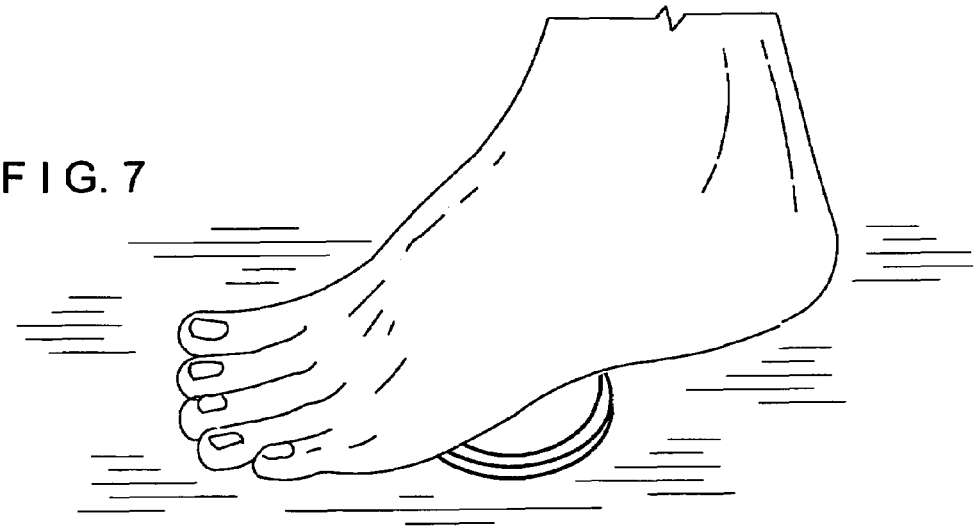

FIG. 8
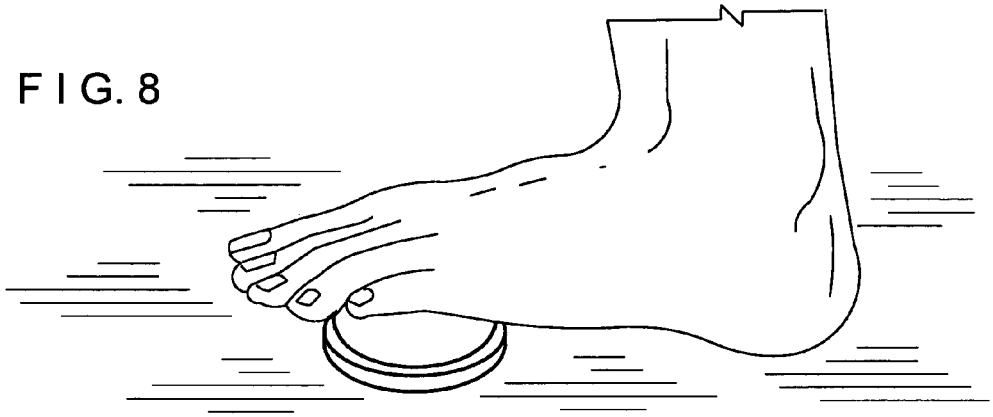
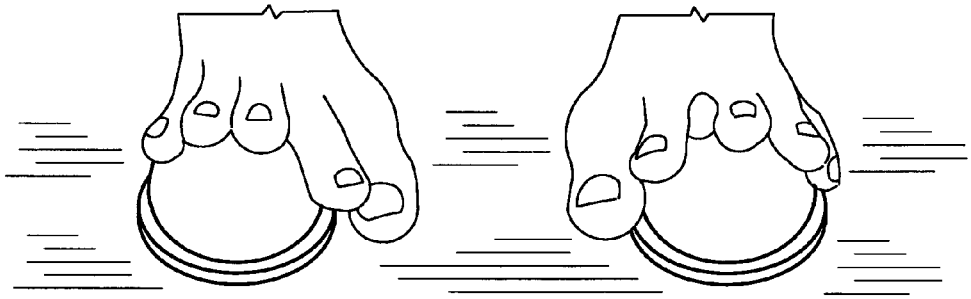
FIG. 9
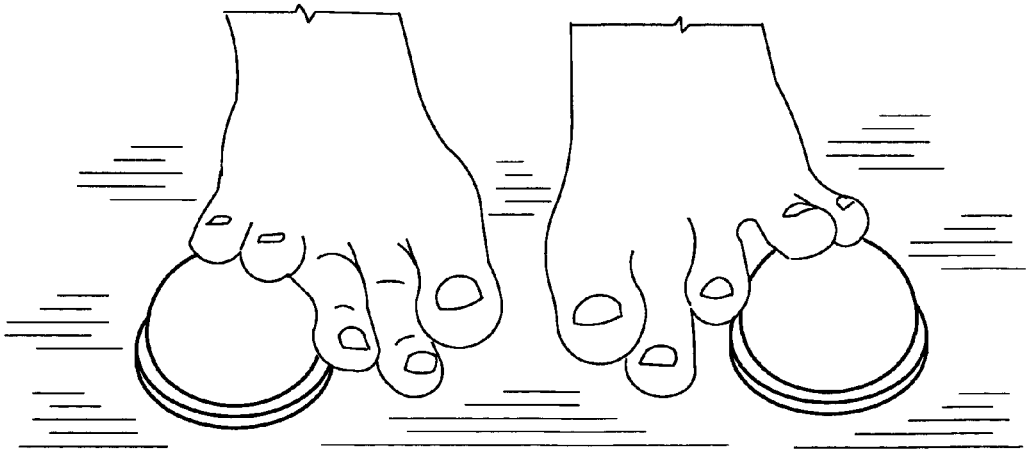
FIG. 10

METHOD AND DEVICE FOR FOOT THERAPY

This application claims the benefit of U.S. Provisional Application No. 60/372,015, filed Apr. 12, 2002.

BACKGROUND OF THE INVENTION

The invention relates to a system for foot therapy and a device therefor.

The human foot extending between toes and heel is a complex structure of many bones, muscles and nerves for complex functions supporting and providing information to the body. The functional complexity is confirmed anecdotally by the idiom of cold feet, the convention linking wet feet and colds and studies known a reflexology that link portions of the feet (right and left) to other parts of the body such as the lung, liver and stomach. Foot therapy therefore includes therapy for both foot and body structures.

SUMMARY OF THE INVENTION

To these and other ends, a device for foot therapy is a central, generally spherical dome with a rim about a generally circular, generally planar base of the dome.

A system of foot therapy including the device comprises supporting the device on its base and pressing a selected portion of the bottom of a foot against the dome. Preferably the base of the dome is supported on a floor and the selected portion of the foot is pressed against the dome from a standing or chair-sitting position.

DESCRIPTION OF THE DRAWING

The device of a preferred embodiment that illustrates but does not limit the invention will now be described with reference to a drawing, wherein:

FIG. 5 is a front/top perspective view of a lateral-heel pressing-down position of the system using the device (not visible);

FIG. 6 is a front/top/left-side perspective view of a medial position of the system using the device;

FIG. 7 is a left-side/top perspective view of a metatarsals position of the system using the device;

FIG. 8 is a left-side/front/top perspective view of a heels lowered-to-the-floor position of the system using the device;

FIG. 9 is a front/top perspective view of a mid-three toes stretched position of the system using the device;

FIG. 10 is a front/top perspective view of a last-two toes stretched position of the system using the device;

DESCRIPTION OF THE PREFERRED DEVICE AND SYSTEM

Figure 1:
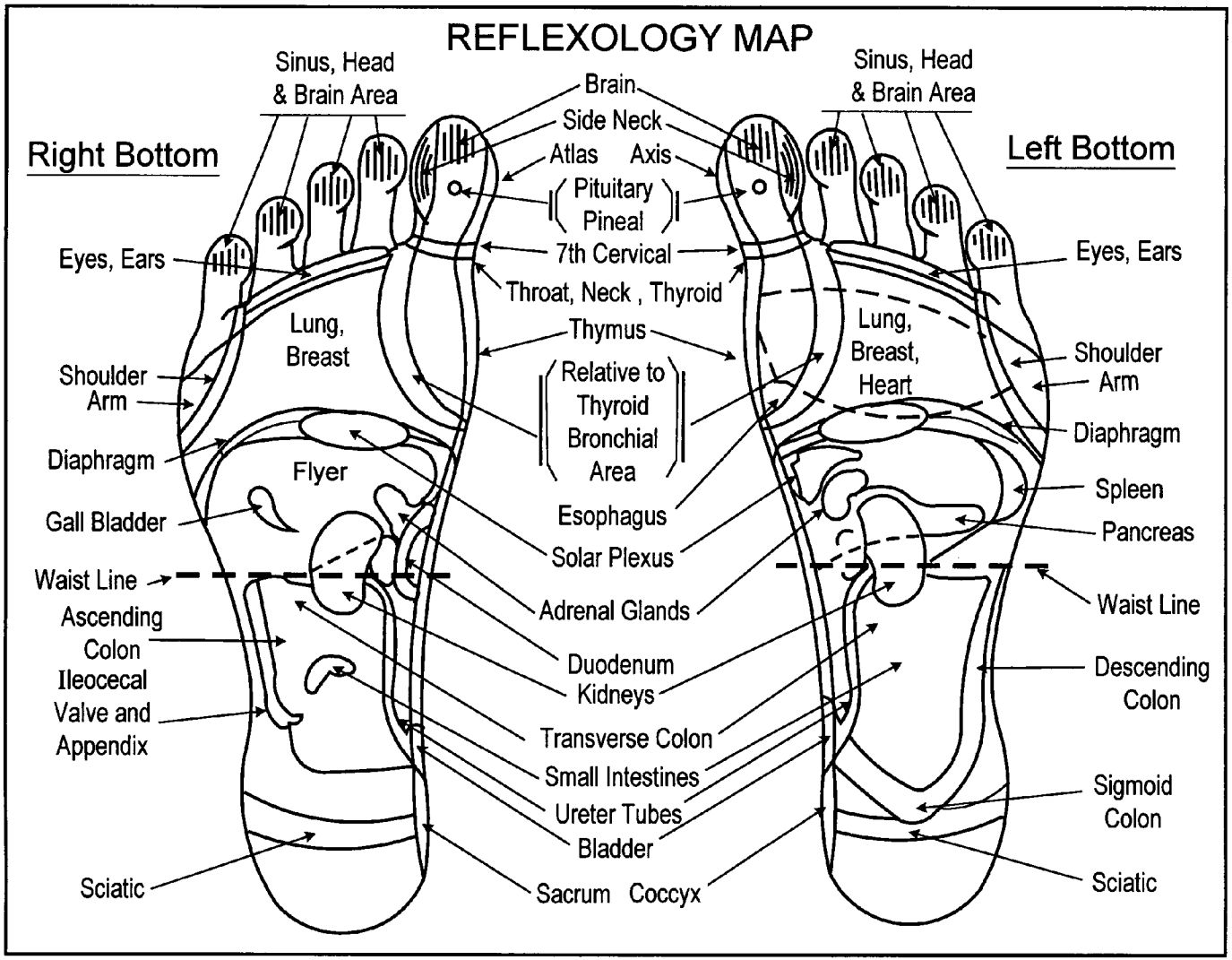
FIG. 1 PRIOR ART
FIG. 1 is a reflexology map of right and left human feet.

FIG. 1 is a map of reflexology areas on the bottoms of right and left human feet whereby a system of foot therapy pressing indicated areas may relate to the indicated body parts as well as the sections of the feet that are pressed.

Figure 2:
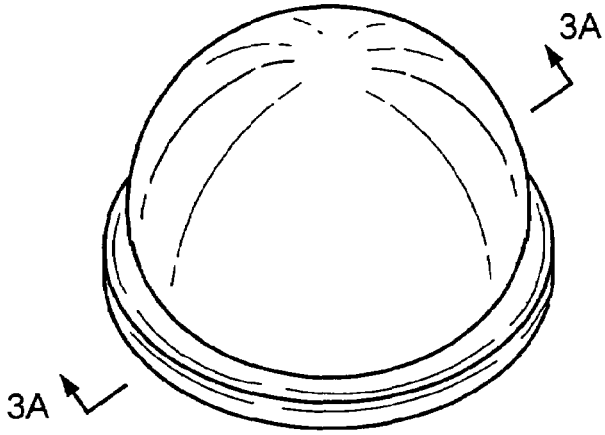
FIG. 2 is a top/front perspective view of a preferred embodiment of the device, the side and rear portions that are not shown being mirror images of the portions that are shown.
Figure 3A:
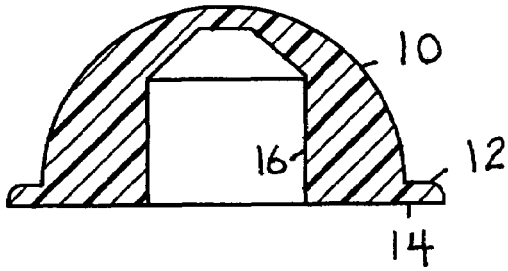
FIG. 3A is a diametric sectional elevation of the device along line 3A-3A in FIG. 2.
Figure 3B:
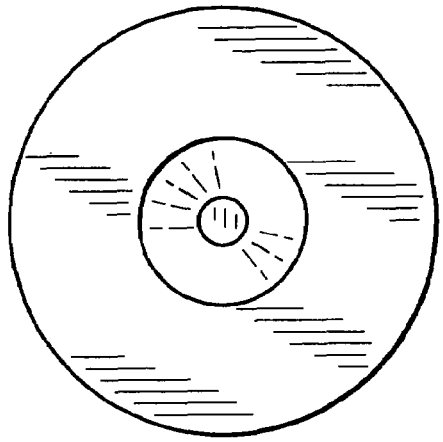
FIG. 3B is a bottom plan view of the device.

FIGS. 2 and 3 show a device for system of foot therapy that may relate to the reflexolory areas of FIG. 1 or the sections of feet that are pressed against the device. The device has a central, substantially spherical dome 10 against which a foot is pressed with a rim or bead 12, i.e., a bead-rim structure about a generally circular, generally planar base 14 of the dome. At least the dome is made of a resilient material that compresses and/or deforms but does not collapse under average and/or normal human body weight such as, preferably, plastic of recycle category 3. To aid the deformation that does not collapse under average and/or normal human body weight, a blind hole 16 preferably extends from the base more than half the height of the dome to a frustum-shaped end within the dome. A preferred embodiment of the device has a base diameter including the rim of about 74 mm, a rim of uniform projection from the dome of about 5 mm, a height of the dome from the base of about 35 mm, a diameter of the blind hole of about 30 mm, a total depth of the blind hole from the base including the frustum of about 34 mm, and a depth of the blind hole from the base to the frustum of about 26 mm.

A system of therapy using the device relates to the structure of the foot. A person's feet may be pressed on the dome of the device individually or, preferably, together on corresponding devices. However, as the devices and pressing of the feet are the same, only one foot will be described.

Figure 4:
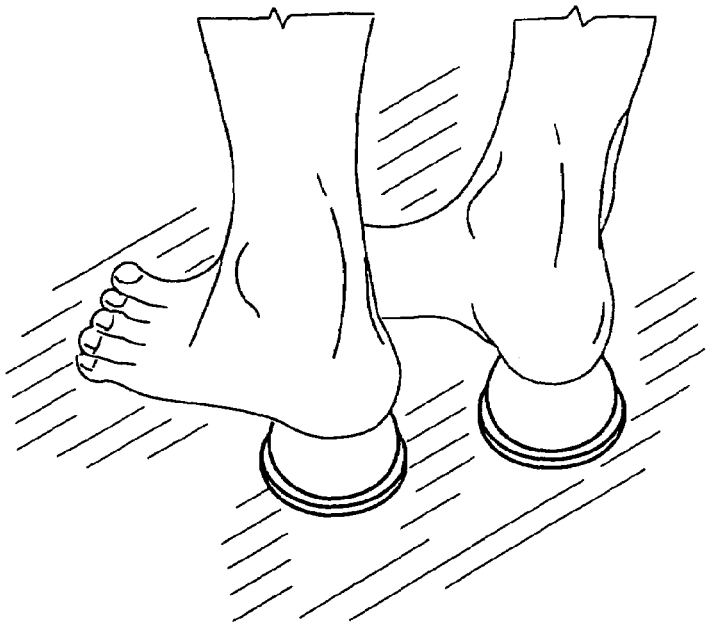
FIG. 4 is a rear/top perspective view of a beginning position of system using the device.

FIG. 4 shows a beginning position in which the base of a pair of the devices are placed on the floor 8-10 inches apart or, preferably, a distance corresponding to hip width. The center of the heel of each foot is then pressed onto the dome of a device preferably, as with the other uses of the device described, from a standing position. If it is too painful to do this at first with both feet together, it can be done one foot at a time, leaning against a wall, and/or holding onto a tabletop of the back of a chair. The foot should be pressed against the dome of the device so that the dome sinks into the heel.

As shown in FIG. 5, the foot is then moved so that the lateral (outside) of the heel is pressing onto the dome. After a breath or two, the foot is moved back to the position with the heel centered on the dome shown in FIG. 4.

As shown in FIG. 6, the foot is then moved so that the medial (inside) of the heel is pressing onto the dome. After a breath or two, the foot is then moved back to the position with the heel centered on the dome shown in FIG. 4.

As shown in FIG. 7, the foot is then moved, preferably by slowly sliding back along the dome off the heel until the dome presses into the arch area of the foot. This position is preferably kept for at least 15 seconds. Then the foot is moved toward the other foot so the the dome presses into the lateral side of the foot. This position is preferably kept for at least 15 seconds. The foot is then moved so that the dome works the medial line of the foot and held for another 15 seconds. This position may be painful for some because they have weak arches. The foot is then moved back to center and slid slightly back, held there for 15 seconds, and then moved slowly further down. This permits the foot to begin again pressing the dome at the lateral line of the foot but further toward the toes, held for 15 seconds, moved toward the medial line, pressed and held for 15 seconds, and so continued in small increments working the pressing against the dome toward the ball of the foot.

As shown in FIG. 8, when the dome is medially pressed to the foot at the ball, the heel is lowered to the floor. The foot is then worked against the dome as previously: center, lateral, medial, with holding at each point.

Figure 11:
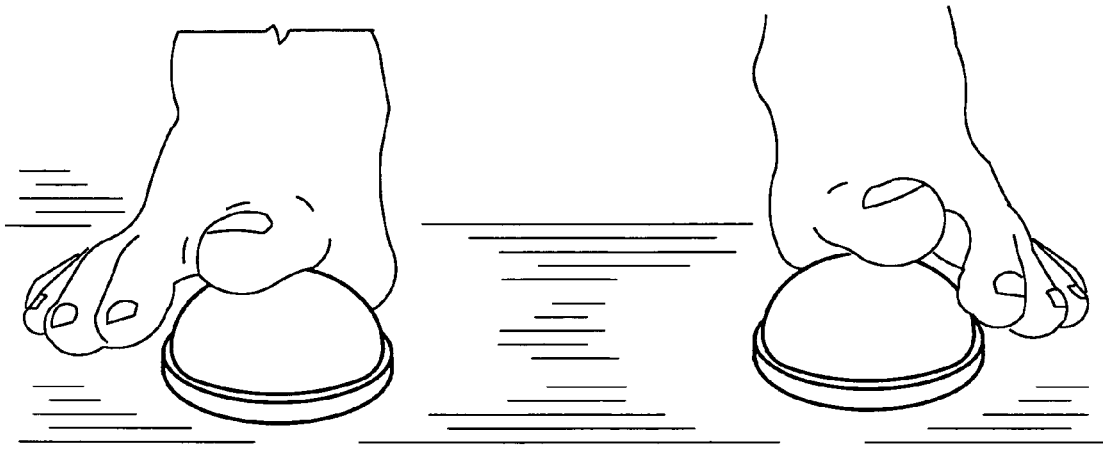
FIG. 11 is a front/top perspective view of a large-toes stretched position of the system using the device.
Figure 12:
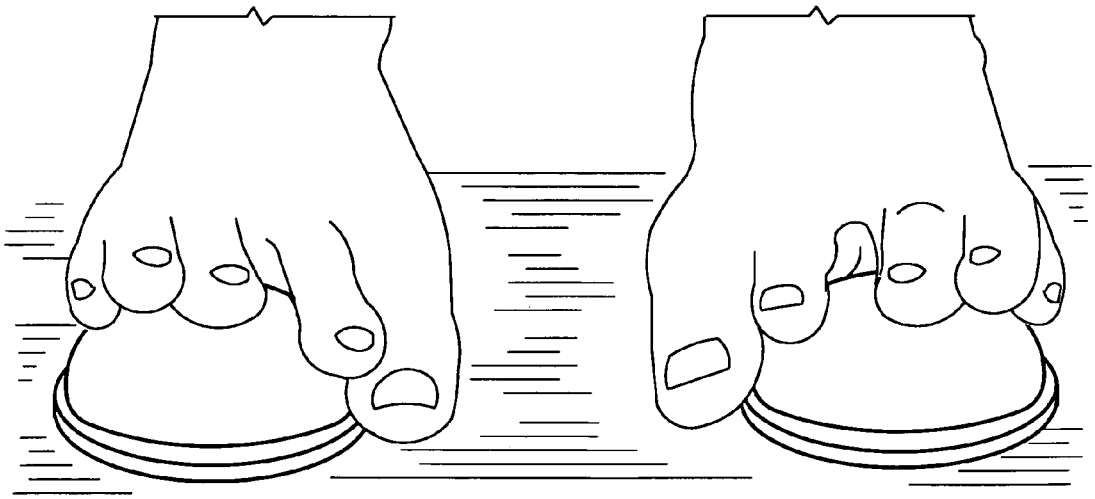
FIG. 12 is a front/top perspective view of a middle-toes stretched position of the system using the device.

As shown in FIG. 9, the dome is then pressed so the middle three toes are stretching up on the dome. This position is held for 15 seconds before the foot is moved over to work the fourth and pinkie toes to stretch up on the dome as shown in FIG. 10 and held for 15 seconds. The foot is then moved so the big and second toes are stretching up onto the dome as shown in FIG. 11 and again held for 15 seconds. Thereafter, the foot is centered again as shown in FIGS. 9 and 12, so that the routine can cycle again from the positions shown in FIGS. 9-12, preferably twice more.

Then the foot should be pressed on the floor without the device. By standing at this time with both feet on the floor the effects of the system on the foot structure (or structures of both feet if twin devices have been used) should be felt. A walk around should permit one to observe and/or feel the way the system has structurally affected the walking and foot, hip, knee and ankle alignments. Walking should feel easier, with greater flexibility, as a result of this structural therapy with the device, which may be repeated as often as desired. For example, it can even be repeated under a desk or while sitting doing other things.

The system using the device can also be applied relative to the reflexology areas of FIG. 1, but it is recommended to start with a foot saving structural routine as described above. This routine absolutely stimulates all the reflex points in the foot as it corrects and improves the structural alignment and muscle quality of the foot. Once the structure is more aligned and toned then the following detailed work is recommended on specific reflex points, which usually are much less sensitive once the structure is corrected.

1. It is recommended to start by placing both heels directly centered on the device.

2. Work the heels just like in the first routine described above to begin to prepare the foot, center, medial and lateral.

3. With the device just below the heel (the arch area); work the central, then lateral, then medial line, holding about 15 seconds at each point.

4. Follow the reflexology map and work (press the foot against the dome of the device) at the specific points of the map of FIG. 1 one wishes to stimulate relative to the indicated organs or points desired to be stimulated.

5. As many points (areas) of the foot may be stimulated by pressing against the dome as desired. Hold each point for 15-30 seconds. If points are very painful start at 5 seconds and gradually work up to 30 seconds.

6. If certain points (areas) on the foot remain extremely painful, it is recommended that a physician be consulted regarding the particular organ or body part indicated at the corresponding portion of the map of FIG. 1.

Variations, combinations and permutations of the device and the system using it as may occur to those of ordinary skill in the art are considered as equivalents within the scope of the following claims.

The invention claimed is:

1. In a foot-therapy device having a dome for foot therapy the improvements consisting essentially wherein the dome is a central, substantially solid but resilient, substantially hemispherical dome with a bead rim about and extending a substantially circular, generally planar base of the dome that extends substantially across the dome;

wherein at least the dome is made of a resilient material that compresses and/or deforms but does not collapse under average and/or normal human body weight and further comprising a blind hole that extends from the base more than half a height of the dome to a frustum-shaped end within the dome, to aid the deformation that does not collapse under average and/or normal human body weight.

2. The device according to claim 1, wherein the material is plastic of recycle category 3.

* * * * *